US006276312B1

(12) United States Patent
Summan et al.

(10) Patent No.: US 6,276,312 B1
(45) Date of Patent: Aug. 21, 2001

(54) THERMAL CONTROL COOLING SYSTEM VACUUM VALVE

(75) Inventors: Dennis J. Summan; Robert S. Harris, both of Connersville, IN (US)

(73) Assignee: Stant Manufacturing Inc., Connersville, IN (US)

( * ) Notice: Subject to any disclaimer, the term of this patent is extended or adjusted under 35 U.S.C. 154(b) by 0 days.

(21) Appl. No.: 09/435,226

(22) Filed: Nov. 5, 1999

Related U.S. Application Data

(60) Provisional application No. 60/107,410, filed on Nov. 6, 1998.

(51) Int. Cl.[7] ..... F01P 3/22
(52) U.S. Cl. ..... 123/41.54; 236/61
(58) Field of Search ..... 123/41.54; 236/61

(56) References Cited

U.S. PATENT DOCUMENTS 2,139,395 * 12/1938 Walker ..... 220/44
2,333,993 * 11/1943 Frailing ..... 123/178
2,603,379 7/1952 Friend .
3,074,588 1/1963 Burdue .
3,373,894 3/1968 Johnson .
3,878,965 4/1975 Crute .
5,114,035 5/1992 Brown .
5,248,052 * 9/1993 Mellinger et al. ..... 220/202

* cited by examiner

*Primary Examiner*—Tony M. Argenbright
*Assistant Examiner*—Katrina B. Harris
(74) *Attorney, Agent, or Firm*—Barnes & Thornburg

(57) ABSTRACT

A cooling system closure includes a closure apparatus adapted to mount on a cooling system and formed to include a flow passage arranged to receive fluid discharged from the cooling system and a relief valve positioned to move between an opened position permitting fluid to flow through the flow passage and a closed position blocking the flow of fluid through the flow passage. The relief valve includes a temperature-activated element moving to a first position when heated to a first predetermined temperature to urge the relief valve to the closed position and a second position when cooled below a second predetermined temperature to permit the relief valve to move to the opened position.

52 Claims, 9 Drawing Sheets

THERMAL CONTROL COOLING SYSTEM VACUUM VALVE

This application claims priority under U.S.C. § 119 (e) to U.S. Provisional Application No. 60/107,410, filed Nov. 6, 1998, which is expressly incorporated by reference herein.

BACKGROUND AND SUMMARY OF THE INVENTION

The present invention relates generally to cooling systems for internal combustion engines. More particularly, the present invention relates to cooling system closures having a pressure-relief valve configured to regulate the flow of coolant and vapor from the cooling system and a vacuum-relief valve configured to regulate the return of coolant and vapor to the cooling system.

Internal combustion engines which are liquid cooled incorporate cooling systems having radiators coupled to the engine to dissipate heat generated by the engine. As radiator fluid (i.e., coolant) passes through the radiator, heat is given off to the environment and now relatively cooler fluid is returned to the engine.

After the engine is started, the operating temperature of the engine increases, causing an increase in the pressure in the cooling system. The cooling system closure includes a pressure-relief valve which is normally closed to prevent the escape of radiator fluid when normal pressures are generated within the cooling system. However, when the pressure in the cooling system acting on an area defined by the valve exceeds the closure force applied to the valve by the pressure-relief spring, the valve is "pushed open" by such pressure and radiator fluid is discharged from the radiator past the pressure-relief valve into an overflow tank.

The overflow fluid or coolant is returned to the radiator upon the development of vacuum or subatmospheric pressure within the cooling system after the engine is cooled. The cooling system closure also includes a vacuum-relief valve which is normally open. Typically, the vacuum-relief valve is moved to a closed position by a "surge" of pressure and steam during a relatively quick warmup of the coolant. However, on occasion, the vacuum-relief valve may not be moved to the closed position because the coolant warms up more gradually and no surge develops.

According to the present invention, a cooling system closure includes a closure apparatus and a relief valve. The closure apparatus is adapted to mount on a cooling system and formed to include a flow passage arranged to receive fluid discharged from the cooling system. The relief valve is positioned to move between an opened position permitting fluid to flow through the flow passage and a closed position blocking the flow of fluid through the flow passage. The relief valve includes a temperature-activated element moving to a first position when heated to a first predetermined temperature to urge the relief valve to the closed position and a second position when cooled below a second predetermined temperature to permit the relief valve to move to the opened position.

According to a preferred embodiment of the present invention, the relief valve further includes a valve member and the temperature-activated element is made of a spring material to yieldably urge the valve member to block the flow of fluid through the flow passage when the temperature-activated element is above the first predetermined temperature. According to another preferred embodiment of the present invention, the relief valve further includes a valve member and a spring. When the temperature-activated element is heated above the first predetermined temperature, it cooperates with the spring to urge the valve member to block the flow of fluid through the flow passage. According to yet another preferred embodiment of the present invention, the temperature-activated element is positioned to block the flow of fluid through the flow passage when heated above the first predetermined temperature and to permit the flow of fluid through the flow passage when cooled below a second predetermined temperature.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
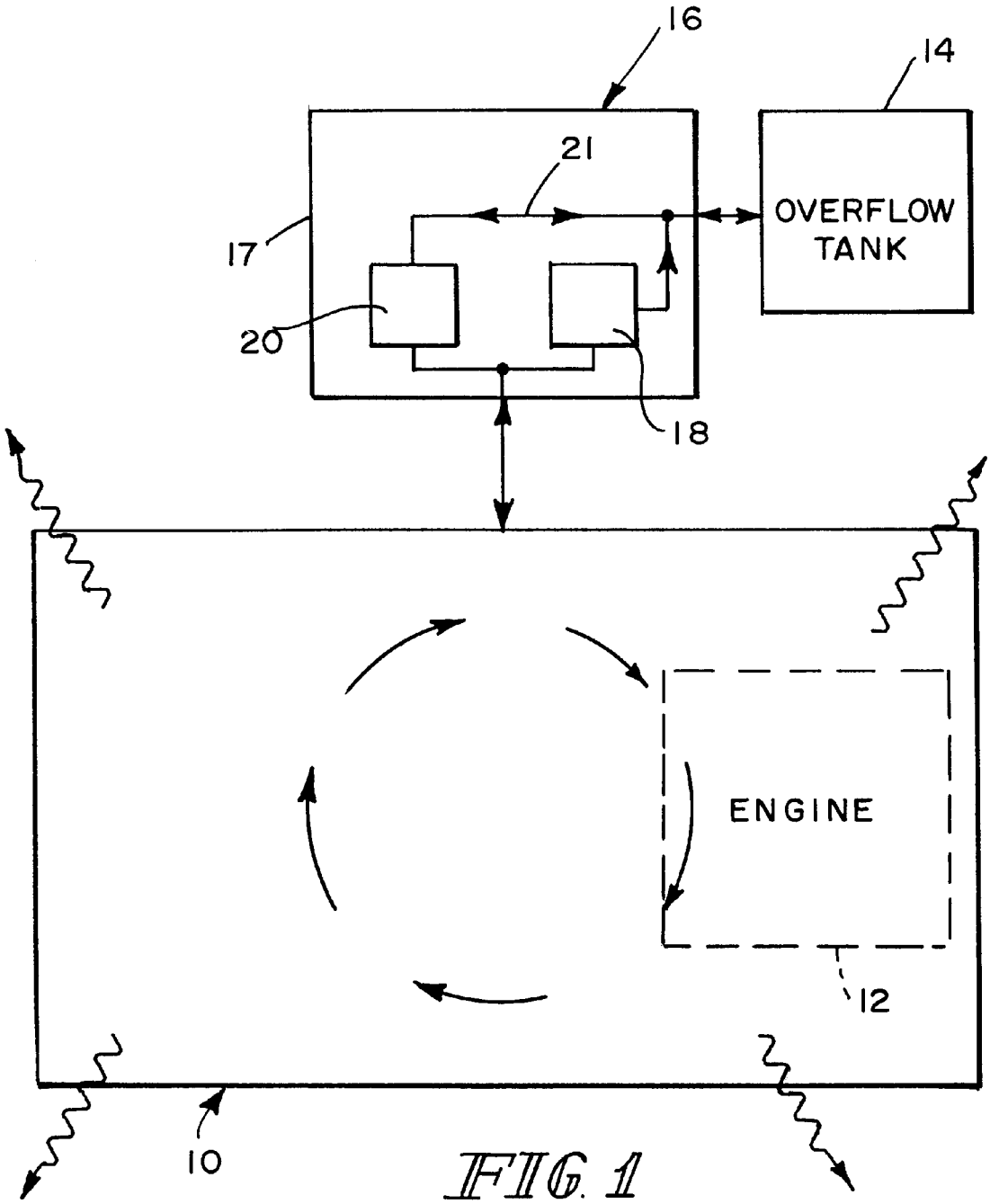
FIG. 1 is a diagrammatic view of the present invention showing coolant being circulated through a cooling system to remove heat from the coolant, an overflow tank, and a cooling system closure positioned between the cooling system and the overflow tank to control the flow of coolant therebetween.

As shown in FIG. 1, a cooling system 10 is provided to circulate coolant through an internal combustion engine 12 to remove excess heat generated during operation of engine 12. After startup of engine 12, the coolant begins to heat up and expand as the temperature of the coolant increases. A coolant overflow tank 14 is provided to "capture" the extra volume of coolant generated during this expansion. After the engine is turned off, the coolant begins to cool and contract so that the coolant in the overflow tank is drawn back into cooling system 10 by a negative pressure condition that develops in cooling system 10. A cooling system closure 16 is provided between cooling system 10 and overflow tank 14 to control the flow of fluids (vapor and liquid coolant and air) therebetween during warm-up and cool-down of engine 12 and cooling system 10.

Cooling system closure 16 includes a closure apparatus 17 adapted to mount on and seal cooling system 10 and a pressure-relief valve 18 that controls the flow of fluids from cooling system 10 to overflow tank 14 when pressure levels in cooling system 10 exceed a predetermined level. Cooling system closure 16 also includes a temperature-activated vacuum-relief valve 20 that moves between opened and closed positions to control the flow of fluids between overflow tank 14 and cooling system 10.

When cooling system 10 is below a predetermined temperature, vacuum-relief valve 20 is in the opened position to permit fluid communication between cooling system 10 and overflow tank 14 through a flow passage 21 formed in closure apparatus 17. When vacuum-relief valve 20 is in the opened position, air and vapor trapped in cooling system 10 are permitted to escape through flow passage 21 to overflow tank 14. When cooling system 10 is above the predetermined temperature, vacuum-relief valve 20 is urged to the closed position to block the fluid communication between cooling system 10 and overflow tank 14 to prevent excessive amounts of fluid from escaping cooling system 10.

After the engine is turned off, a vacuum or negative pressure condition develops in cooling system 10. This negative pressure condition in cooling system 10 draws vacuum-relief valve 20 to the opened position and fluid stored in overflow tank 14 is pulled through flow passage 21 back into cooling system 10 to help alleviate the negative pressure condition extant in cooling system 10.

Figure 2:
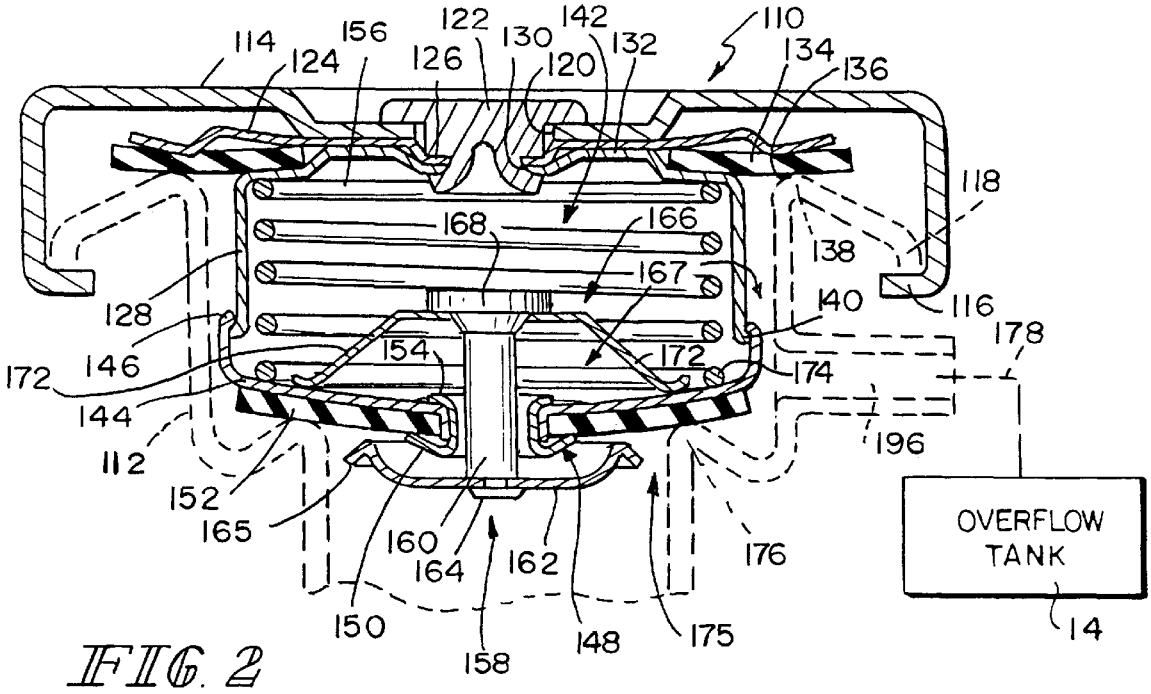
FIG. 2 is a cross-sectional view of a preferred embodiment cooling system closure showing a radiator cap installed on a radiator filler neck, the radiator cap including an upper seal sealing the filler neck from the atmosphere and a vacuum-relief valve in an opened position so that a lower seal permits communication between an overflow tank and the radiator.

Referring now to FIG. 2, a radiator closure 110 according to a preferred embodiment of the invention is shown installed on a radiator filler neck 112. Closure 110 includes a manually manipulable crown or shell 114 covering filler neck 112. Crown 114 has a pair of oppositely opposed cam fingers 116 which pass through corresponding openings (not shown) in filler neck 112 and engage a lip 118 of filler neck 112 when crown 114 is rotated into filler neck 112 thereby to secure closure 110 to filler neck 112. Crown 114 also is shown as having a central aperture 120. A rivet 122 extends through aperture 120 and after staking to its flared shape secures in an assembled condition crown 114, a discoid spring 124 having a central aperture 126, and a bell housing 128 having a central aperture 130.

Crown 114 and bell housing 128 cooperate to define an outer shell of a preferred embodiment closure apparatus. According to alternative embodiments, other configurations of closure apparatus are provided such as permanently or removably mounted closure apparatus on the radiator, hoses, engine, overflow tank, or other cooling system-related component. Such closure apparatus may be separate from the radiator cap or other closure apparatus configured to facilitate filling or draining of the cooling system.

Bell housing 128 has an upper shoulder region 132 which supports a discoid seal 134 made of a suitable sealing material. Seal 134 has an outer peripheral region 136 which makes sealing contact with an upper annular seat 138 of filler neck 112. Discoid spring 124 serves to exert downward forces onto outer peripheral region 136 of seal 134 to ensure sealing contact is made between seal 134 and annular seat 138 when closure 110 is rotated onto filler neck 112.

Bell housing 128 includes a lower radially outwardly extending flange 140 which carries a pressure-relief valve 142. Pressure-relief valve 142 includes a seal support plate 144 having its downward movement limited by the abutment of flange 140 with a plurality of inwardly projecting tabs 146 crimped in seal support plate 144 during assembly. Pressure-relief valve 142 further includes a grommet 148 having a first lip 150 gripping a seal 152 that serves to retain seal 152 adjacent seal support plate 144 and a second lip 154 gripping seal support plate 144 to secure seal 152 adjacent seal support plate 144. Seal 152 can be fabricated from a resilient material, such as rubber.

Pressure-relief valve 142 further includes a pressure spring 156. Further detail of pressure-relief valve 142 is described in U.S. Pat. No. 5,114,035 to Brown, issued May 19, 1992, which is hereby incorporated herein by reference. Other configurations of pressure-relief valves, sealing crowns, seals, and other components of the upper portion of the closure are also within the scope of the present disclosure.

Radiator closure 110 also includes a vacuum-relief valve 158 comprising an elongated shank 160 and a valve member 162 coupled to a lower end 164 of shank 160. Vacuum-relief valve 158 includes a thermally-activated leaf spring 166 made of a yieldable spring material and coupled to an upper end 168 of shank 160. Shank 160 extends through grommet 148 so that lower end 164 and valve member 162 dangle below seal 152 and leaf spring 166 is positioned above seal support plate 144.

Figure 3:
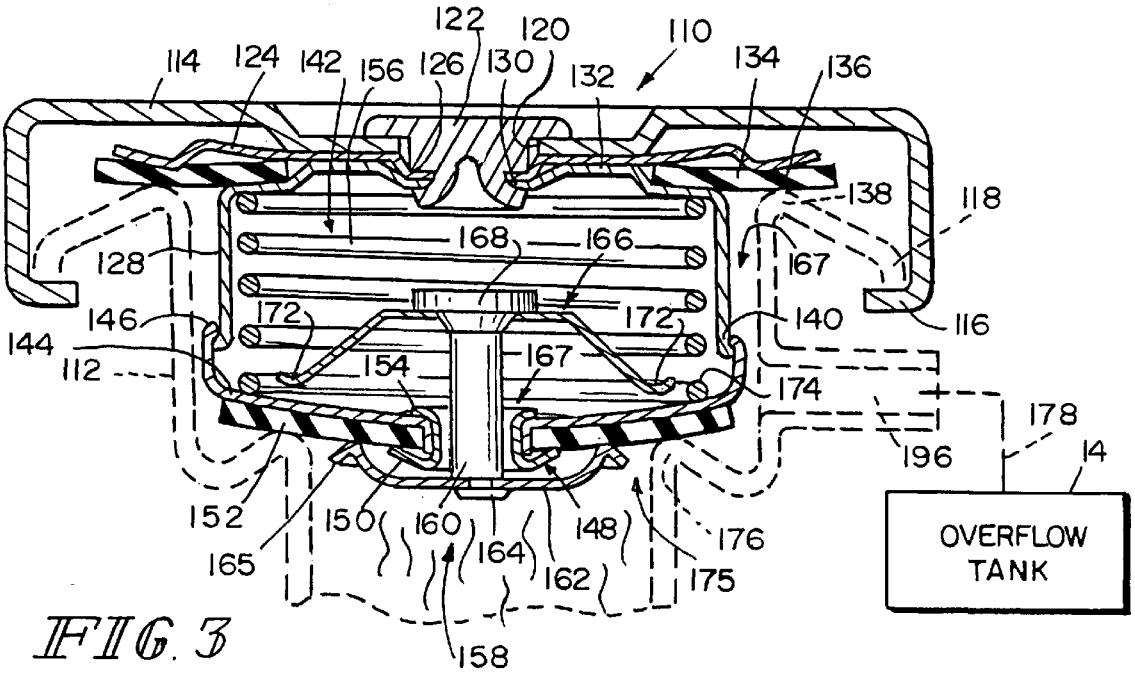
FIG. 3 is a cross-sectional view similar to FIG. 2 showing a surge of pressure and steam moving the vacuum-relief valve to a closed position blocking the flow of vapor to the overflow tank.
Figure 4:
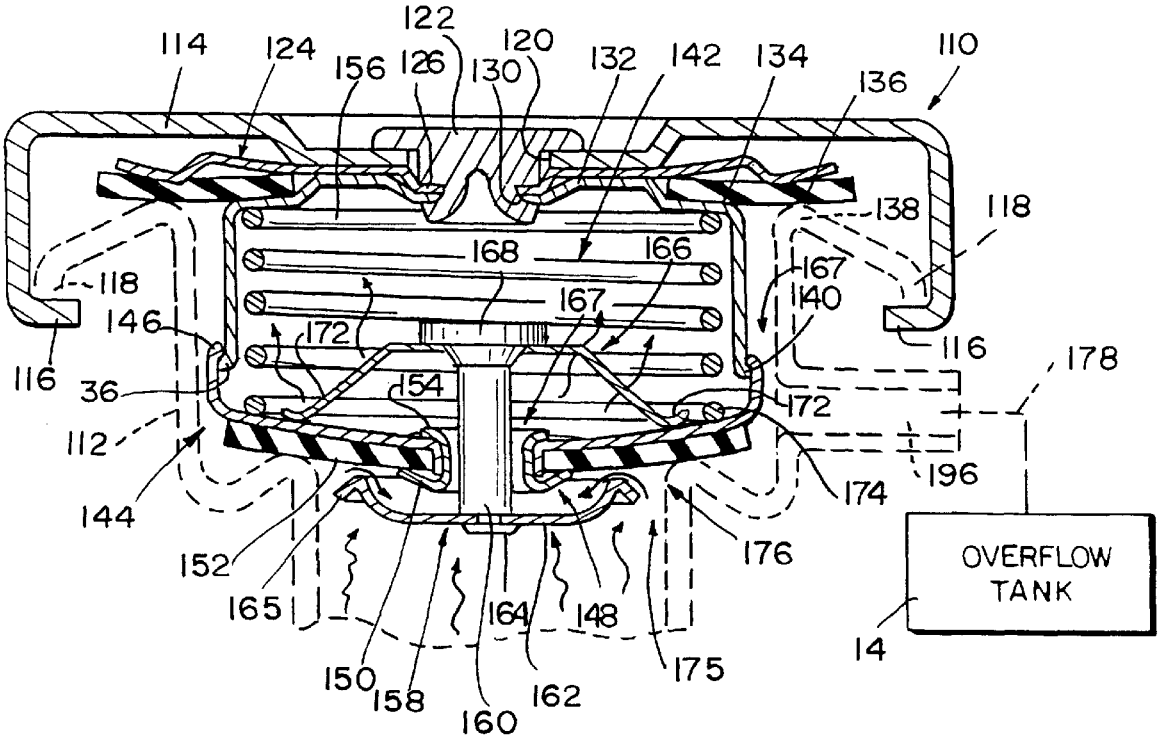
FIG. 4 is a cross-sectional view similar to FIG. 2 showing hot vapor moving through the vacuum-relief valve.
Figure 5:
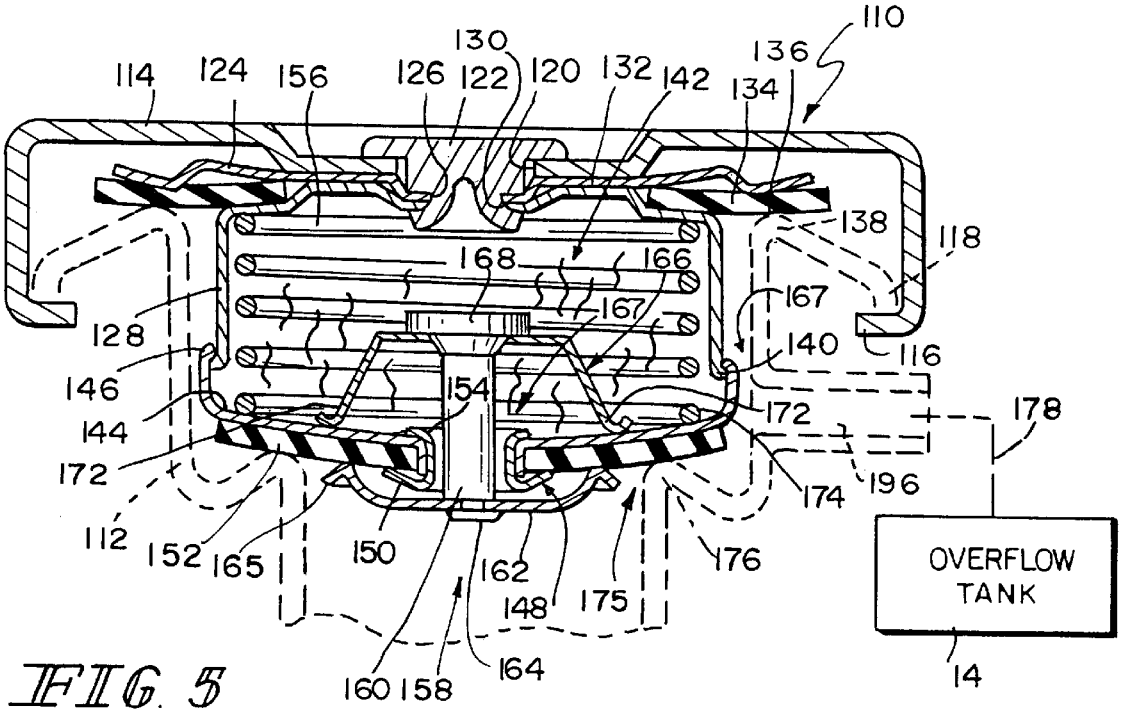
FIG. 5 is a cross-sectional view similar to FIG. 2 showing the hot vapor activating a temperature-activated spring that moves the vacuum-relief valve to the closed position to prevent additional hot vapor from moving past the vacuum-relief valve.

Thermally active leaf spring 166 is temperature-activated. When leaf spring 166 is exposed to temperatures below a predetermined level, it remains in a relaxed-deactivated position as shown in FIGS. 2–4. When leaf spring 166 is exposed to temperatures above a predetermined level, it moves to an activated position and moves shank 160 and valve member 162 to the closed position as shown in FIG. 5.

Leaf spring 166 is formed of an elongated strip of bimetallic material that is bent into the configuration shown in FIGS. 2–6. Leaf spring 166 is formed to include an aperture 170 sized to receive upper end 168 of shank 160 and a pair a legs 172 extending down to and resting on seal support plate 144 as shown in FIGS. 2–4. Other configurations of leaf spring 166 are also within the scope of the present disclosure. For example, the leaf spring could have three or more legs. The spring could also be conical shaped and formed to include various sized and number of slits, slots, or apertures. The spring could also be a disk spring made of thermally activated material or a coil spring made of bimetallic material such that the spring length changes as the temperature of the spring changes.

Bi-metallic materials are made of two layers of different metal types having different coefficients of thermal expansion so that when the temperature of the bimetallic material changes, the metals expand at different rates to change the shape or configuration of leaf spring 166 in response to a change in temperature. When the bimetallic material is heated above a predetermined high temperature, the temperature-activated element changes from a first shape or position to a second shape or position. As the temperature-activated element cools down, it reverts back to the first shape or position. Because of hysteresis inherent in bimetallic materials, the temperature at which the temperature-activated element snaps back to the first shape or position is often at a lower predetermined temperature. According to an alternative embodiment, a memory-metal such as Nitinol, a nickel titanium alloy, that has little or no hysteresis is used for leaf spring 166. Thus, leaf spring 166 could be formed in any configuration or shape of any material that moves to assume a different shape or configuration in response to a change in temperature.

In operation, a bottom turn 174 of pressure spring 156 exerts downward forces on seal support plate 144 such that seal 152 maintains sealing contact with an annular valve seat 176 of filler neck 112 under normal operating conditions. Valve member 162 is normally in the opened position as shown in FIG. 2 and leaf spring 166 is unsprung so that vacuum-relief valve 158 is also "unsprung." This permits excess pressure to be released through a flow passage 167 defined by grommet 148 and bell housing 128 so that the cooling system operates at a lower pressure and reduces the wear and tear on the components of the cooling system.

During operation of the vehicle, the coolant temperature rises relatively quickly a steam or liquid "surge" develops. This surge of steam or liquid pushes valve member 162 to the closed position as shown in FIG. 3 to block the flow of fluid and vapors from the radiator through flow passage 167. On occasion, the coolant temperature rises gradually and little or no surge develops and valve member 162 is not moved to the closed position and remains in the opened position as shown in FIG. 4. Because valve member 162 is not blocking the flow of liquid and vapor through vacuum-relief valve 158, vapor escapes to overflow tank 14 through flow passage 167. As vapor passes through vacuum-relief valve 158, the temperature of leaf spring 166 rises and snaps to the activated position as shown in FIG. 5. According to the preferred embodiment of the present invention, leaf spring 166 activates at a predetermined temperature of approximately 200–210° F. (just below the boiling point of the coolant), but it is within the scope of the present disclosure for other temperatures to be selected. When leaf spring 166 is activated, vacuum-relief valve 158 is "sprung" so that valve member 162 is urged to the closed position to block the flow of fluids through flow passage 167.

During activation, leaf spring 166 moves shank 160 and valve member 162 to the closed position blocking the flow of additional vapor or liquid through vacuum-relief valve 158 and flow passage 167. If leaf spring 166 moved valve member 162 to the opened position, vapor and liquid could continue to pass to overflow tank 14 and into the atmosphere. If too much vapor and liquid were permitted to escape in this manner, the radiator and the remainder of the cooling system would develop a coolant deficiency and the cooling capacity of the cooling system would decrease. Such a decrease could allow areas within the cooling system to develop air pockets. The areas normally protected by fluid vacated by the air pockets could suffer catastrophic failure and severely damage the engine. Thus, leaf spring 166 retards or prevents this catastrophic failure by preventing excess vapor from escaping the cooling system.

Figure 6:
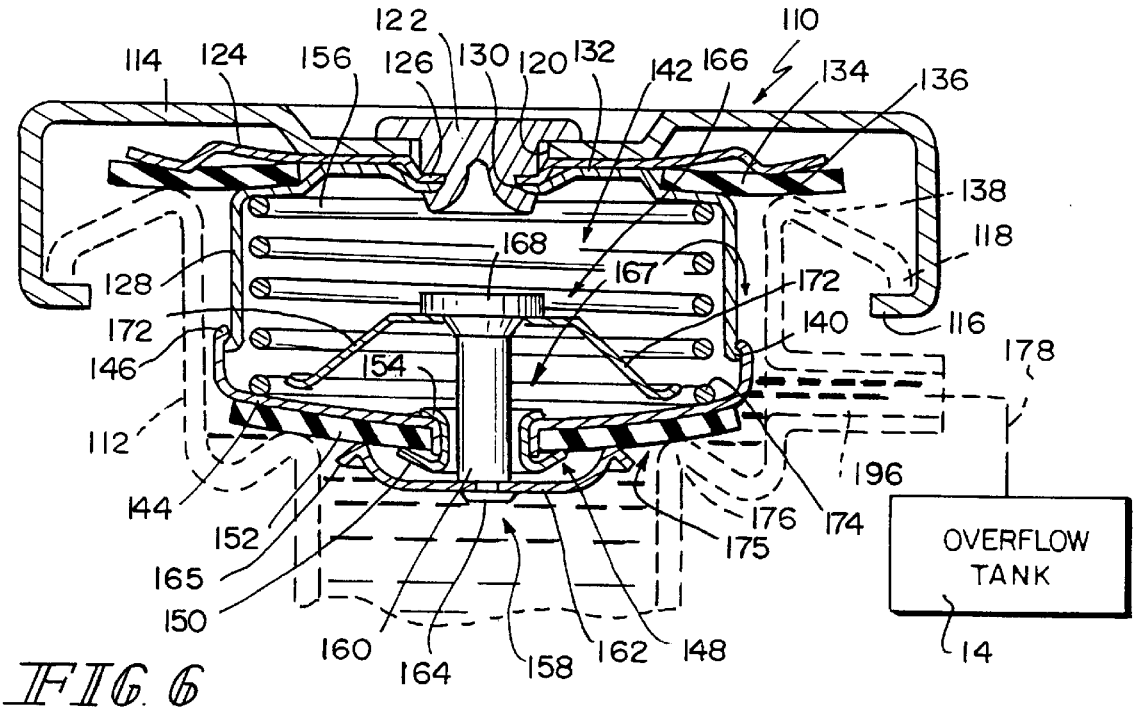
FIG. 6 is a cross-sectional view similar to FIG. 2 showing a pressure-relief valve moved by excess coolant so that the excess coolant passes from the radiator to the overflow tank.

Upon the development of abnormally high superatmospheric liquid pressure in the radiator, creating upward liquid pressures on valve member 162 and a peripheral region 175 of seal 152, pressure-relief valve 142 lifts bodily upward, permitting the flow of radiator fluid around seal 152 and out an overflow port 196 through a tube 178 running to overflow tank 14 as shown in FIG. 6.

Figure 7:
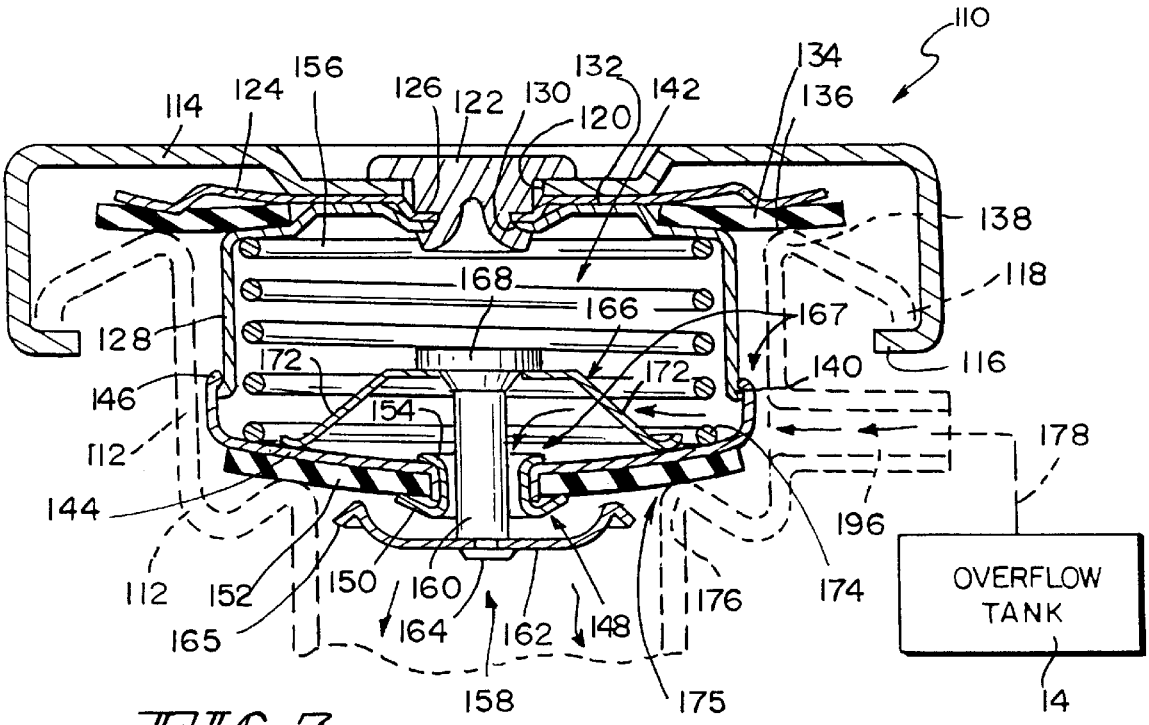
FIG. 7 is a cross-sectional view similar to FIG. 2 showing a vacuum condition existing in the radiator to pull the vacuum-relief valve against the activated temperature-activated spring so that coolant is drawn from the overflow tank to the radiator past the vacuum-relief valve.
Figure 8:
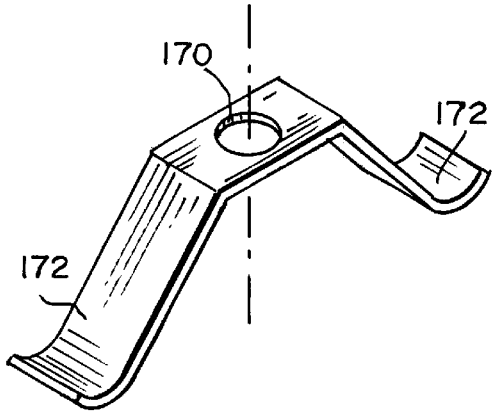
FIG. 8 is a perspective view of the temperature-activated spring of FIG. 2 including an aperture and a pair of legs.

Upon the development of subatmospheric (negative) pressures within the radiator when the engine has cooled, pressure-relief valve 142 reseats on valve seat 176 and valve member 162 moves to the opened position against activated leaf spring 166, thereby allowing coolant to be siphoned back from overflow tank 14 to pass through flow passage 167 defined by the clearance region between cylinder 178 and shank 160, and past peripheral region 165 of valve member 162 to return to the radiator fluid reservoir as shown in FIG. 7. If the coolant returning from overflow tank 14 is at a temperature below a low predetermined level, thermal leaf spring 166 remains relaxed and coolant continues to flow from overflow tank 14 to the radiator. If the coolant returning from overflow tank 14 is at a temperature above the predetermined high level, thermal leaf spring 166 activates, but valve member 162 continues to pull against leaf spring 166 and permit the flow of coolant back to the radiator through flow passage 167. Leaf spring 166 has a predetermined spring constant that permits compression during vacuum conditions to permit valve member 162 to be drawn to the opened position against the bias of activated leaf spring 166 to relieve the vacuum condition.

Figure 9:
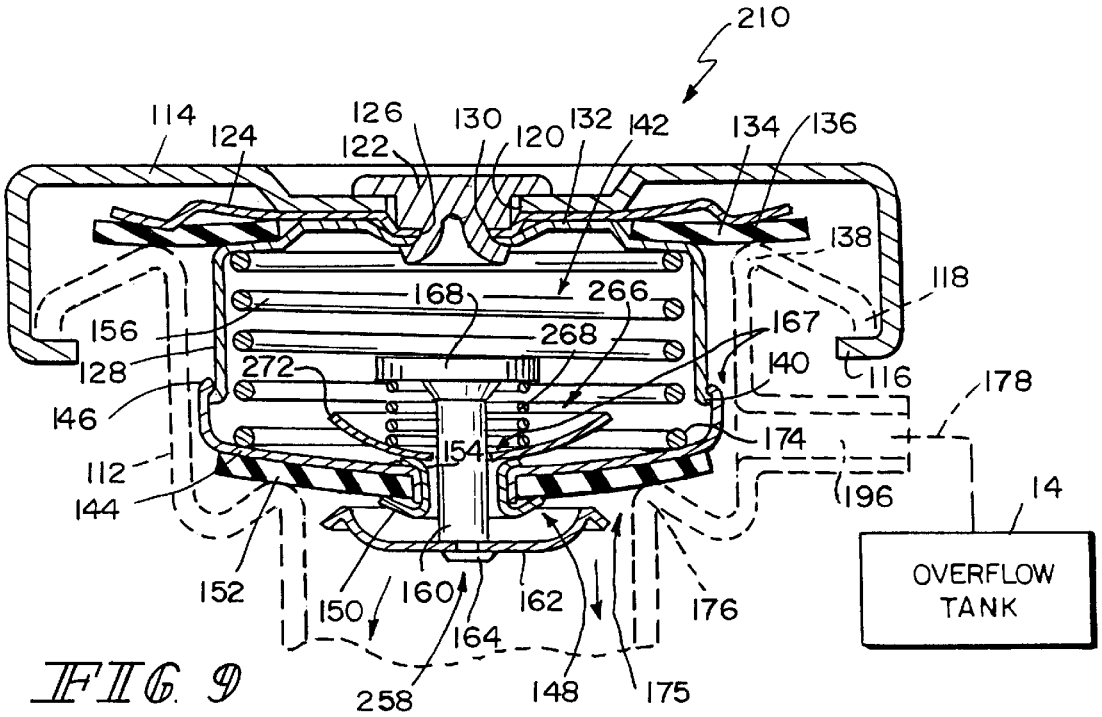
FIG. 9 is a cross-sectional view of another preferred embodiment cooling system closure showing a radiator cap installed on a radiator filler neck, the radiator cap including an upper seal sealing the filler neck from the atmosphere and a vacuum-relief valve in an opened position to permit communication between an overflow tank and the radiator.
Figure 12:
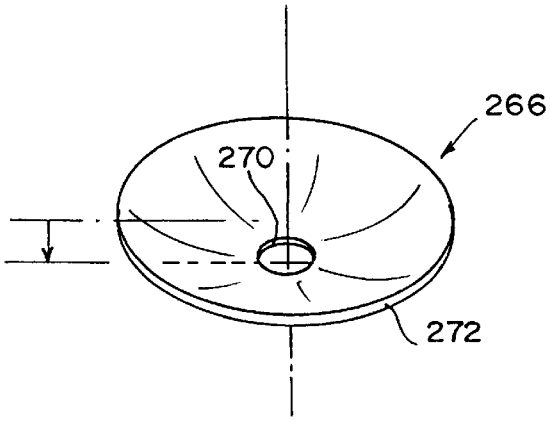
FIG. 12 is a perspective view of the temperature-activated spring mount of FIG. 9 in the deactivated position showing the temperature-activated spring mount including a cup-shaped body and an aperture.
Figure 13:
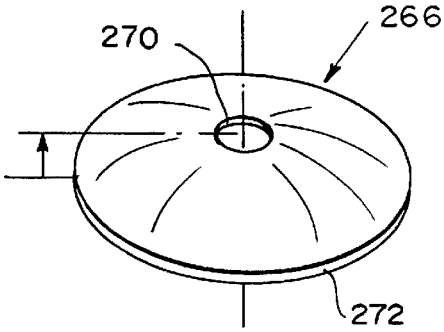
FIG. 13 is a perspective view of the temperature-activated spring mount of FIG. 9 in the activated position.

Referring now to FIG. 9, a radiator closure 210 according to another preferred embodiment of the invention is shown installed on radiator filler neck 112. Radiator closure 210 includes a vacuum-relief valve 258 comprising elongated shank 160 and valve member 162 coupled to lower end 164 of shank 160. Vacuum-relief valve 258 includes a thermally-activated spring mount 266 and a spring 268 positioned between upper end 168 of shank 160 and spring mount 266. Shank 160 extends through grommet 148 so that lower end 164 and valve member 162 dangle below seal 152 and spring mount 266 is positioned above seal support plate 144.

Figure 10:
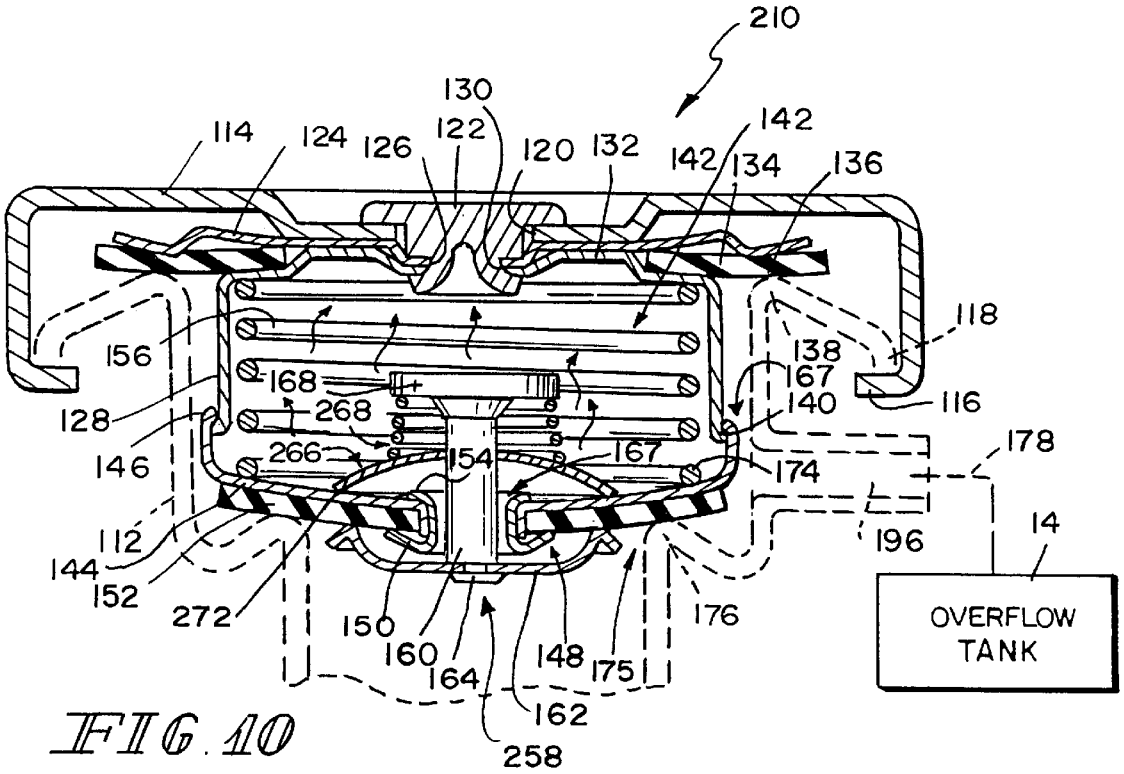
FIG. 10 is a cross-sectional view similar to FIG. 9 showing hot vapor activating a temperature-activated spring mount that cooperates with a spring to urge the vacuum-relief valve to the closed position to prevent additional hot vapor from moving past the vacuum-relief valve.

Thermally active spring mount 266 is temperature-activated. When spring mount 266 is exposed to temperatures below a predetermined level, it remains in a relaxed-deactivated position as shown in FIG. 9. When spring mount 266 is exposed to temperatures above a predetermined level, it moves to an activated position and compresses spring 268 as shown in FIG. 10. Compressed spring 268 moves shank 160 and valve member 162 to the closed position blocking the flow of fluid through flow passage 167.

Figure 11:
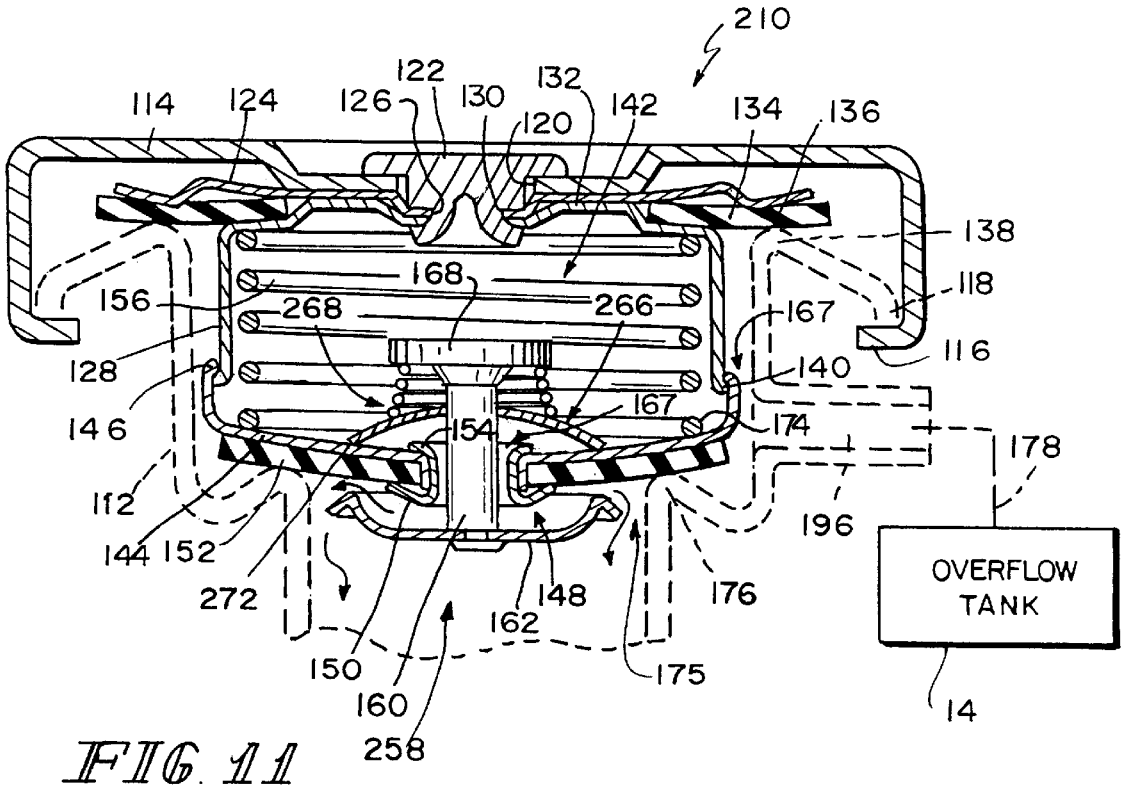
FIG. 11 is a cross-sectional view similar to FIG. 9 showing a vacuum condition existing in the radiator to pull the vacuum-relief valve against the activated temperature-activated spring mount and spring so that coolant is drawn from the overflow tank to the radiator past the vacuum-relief valve.

Spring mount 266 is formed from a sheet of bimetallic material that is bent into the disk-shaped configuration shown in FIGS. 9–13. Spring mount 266 is formed to include an aperture 270 sized to receive shank 160 and an outer periphery 272 extending down to and resting on seal support plate 144 when in the activated position as shown in FIGS. 10 and 11. Other configurations of spring mounts 266 are also within the scope of the present disclosure. For example, the spring mount may be in the form of a leaf spring having two or more legs. Thus, spring mount 266 could be formed in any configuration or shape of any material that moves to assume a different shape or configuration in response to a change in temperature to compress spring 268.

In operation, a bottom turn 174 of pressure spring 156 exerts downward forces on seal support plate 144 such that seal 152 maintains sealing contact with an annular valve seat 176 of filler neck 112 under normal operating conditions. Valve member 162 is normally in the opened position as shown in FIG. 9 and spring mount 266 is unsprung so that vacuum-relief valve 258 is also "unsprung." This permits excess pressure to be released through flow passage 167 so that the cooling system operates at a lower pressure and reduces the wear and tear on the components of the cooling system.

During operation of the vehicle, the coolant temperature rises relatively quickly a steam or liquid "surge" develops. This surge of steam or liquid pushes valve member 162 to the closed position to block the flow of fluid and vapors from the radiator through flow passage 167. On occasion, the coolant temperature rises gradually and little or no surge develops and valve member 162 is not moved to the closed position and remains in the opened position. Because valve member 162 is not blocking the flow of liquid and vapor through vacuum-relief valve 258, vapor escapes to overflow tank 14 through flow passage 167.

As vapor passes through vacuum-relief valve 258, the temperature of spring mount 266 rises and snaps to the activated position as shown in FIG. 10 to compress spring 268 from a first level of stored energy when not compressed to a higher second level of stored energy when compressed. According to the preferred embodiment of the present invention, spring mount 266 activates at approximately 200–210° F. (just below the boiling point of the coolant), but it is within the scope of the present disclosure for other temperatures to be selected. When spring mount 266 is activated, vacuum-relief valve 258 is "sprung" so that valve member 162 is urged to the closed position as shown in FIG. 10.

During activation, spring mount 266 compresses spring 268 to move shank 160 and valve member 162 to the closed position blocking the flow of additional vapor or liquid through vacuum-relief valve 258. If spring mount 266 and spring 268 moved valve member 162 to the opened position, vapor and liquid could continue to pass to overflow tank 14 and into the atmosphere. If too much vapor and liquid were permitted to escape in this manner, the radiator and the remainder of the cooling system would develop a coolant deficiency and the cooling capacity of the cooling system would decrease. Such a decrease could allow areas within the cooling system to develop air pockets. The areas normally protected by fluid vacated by the air pockets could suffer catastrophic failure and severely damage the engine. Thus, leaf spring 166 retards or prevents this catastrophic failure by preventing excess vapor from escaping the cooling system.

Upon the development of abnormally high superatmospheric liquid pressure in the radiator, creating upward liquid pressures on valve member 162 and a peripheral region 175 of seal 152, pressure-relief valve 142 lifts bodily upward, permitting the flow of radiator fluid around seal 152 and out overflow port 196 through tube 178 running to overflow tank 14.

Upon the development of subatmospheric (negative) pressures within the radiator when the engine has cooled, pressure-relief valve 142 reseats on valve seat 176 and valve member 162 moves to the opened position against compressed spring 268, thereby allowing coolant to be siphoned back from the overflow tank to pass through the clearance region between cylinder 178 and shank 160, and past peripheral region 165 of valve member 162 to return to the radiator fluid reservoir. If the coolant returning from overflow tank 14 is at a temperature below a low predetermined level, spring mount 266 remains relaxed and coolant continues to flow from overflow tank 14 to the radiator. If the coolant returning from overflow tank 14 is at a temperature above the predetermined high level, spring mount 266 activates, but valve member 162 compresses spring 268 further and permits the flow of coolant back to the radiator as shown in FIG. 11. Spring 268 has a predetermined spring constant that permits compression during vacuum conditions to permit valve member 162 to be drawn to the opened position against the bias of compressed spring 268 to relieve the vacuum condition.

Figure 14:
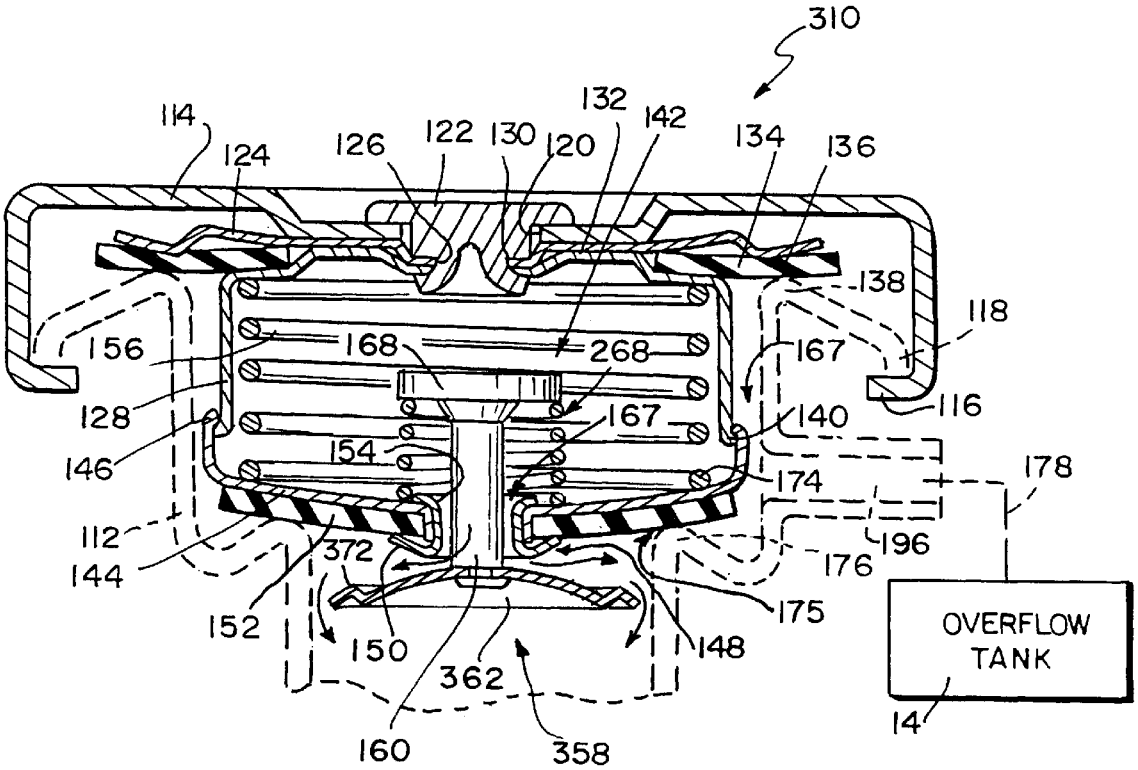
FIG. 14 is a cross-sectional view of yet another preferred embodiment cooling system closure showing a radiator cap installed on a radiator filler neck, the radiator cap including an upper seal sealing the filler neck from the atmosphere and a vacuum-relief valve in an opened position to permit communication between an overflow tank and the radiator.
Figure 17:
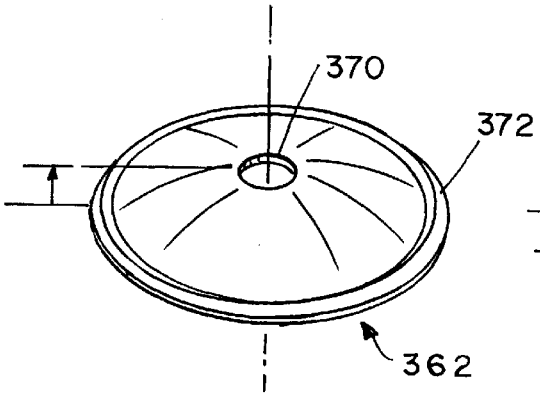
FIG. 17 is a perspective view of the temperature-activated valve member of FIG. 14 in the deactivated position showing the temperature-activated valve member including a disk-shaped body and an aperture.
Figure 18:
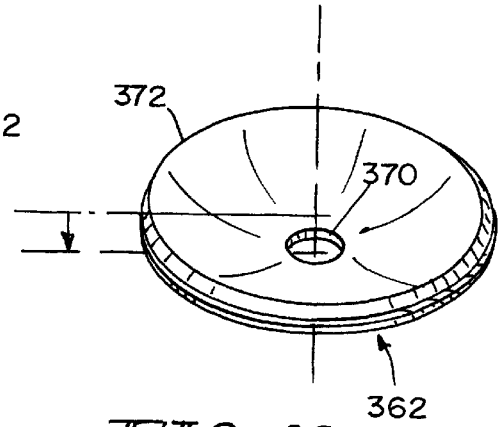
FIG. 18 is a perspective view of the temperature-activated valve member of FIG. 14 in the activated position.

Referring now to FIG. 14, a radiator closure 310 according to another preferred embodiment of the invention is shown installed on radiator filler neck 112. Radiator closure 310 includes a vacuum-relief valve 358 comprising elongated shank 160 and spring 268 coupled to upper end 168 of shank 160. Vacuum-relief valve 358 includes a thermally-activated valve member 362. Shank 160 extends through grommet 148 so that lower end 164 and valve member 362 dangle below seal 152.

Thermally active valve member 362 is temperature-activated. When valve member 362 is exposed to temperatures below a predetermined level, it remains in a relaxed-deactivated position as shown in FIG. 14. When valve member 362 is exposed to temperatures above a predetermined level, it moves to an activated position, pulls shank 160 downwardly, and compresses spring 268 as shown in FIG. 15.

Figure 15:
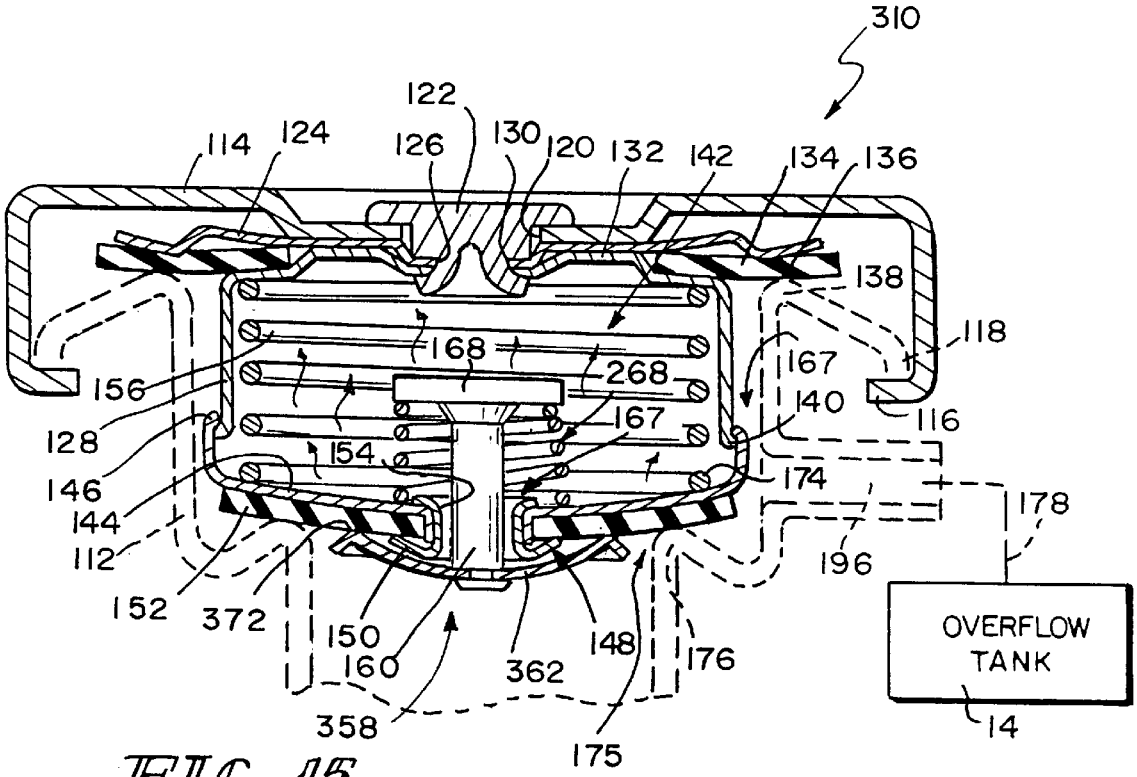
FIG. 15 is a cross-sectional view similar to FIG. 14 showing hot vapor activating a temperature-activated valve member that cooperates with a spring to move the vacuum-relief valve to the closed position to prevent additional hot vapor from passing past the vacuum-relief valve.

Valve member 362 is formed from a sheet of bimetallic material that is bent into the disk-shaped configuration shown in FIGS. 14–18. Valve member 362 is formed to include an aperture 370 sized to receive lower end 164 of shank 160 and an outer periphery 372. Outer periphery 372 is spaced apart from seal 152 when deactivated, as shown in FIG. 14, and extends up to and rests on seal 152 when in the activated position as shown in FIG. 15. Other configurations of valve members 362 are also within the scope of the present disclosure. Thus, valve member 362 could be formed in any configuration or shape of any material that moves to assume a different shape or configuration in response to a change in temperature to contact seal 152.

In operation, a bottom turn 174 of pressure spring 156 exerts downward forces on seal support plate 144 such that seal 152 maintains sealing contact with an annular valve seat 176 of filler neck 112 under normal operating conditions. Valve member 362 is normally in the opened-deactivated position as shown in FIG. 14 so that vacuum-relief valve 358 is "unsprung." This permits excess pressure to be released through flow passage 167 so that the cooling system operates at a lower pressure and reduces the wear and tear on the components of the cooling system.

During operation of the vehicle, the coolant temperature rises relatively quickly a steam or liquid "surge" develops. This surge of steam or liquid activates valve member 362 to the closed position to block the flow of fluid and vapors from the radiator through flow passage 167 as shown in FIG. 15. On occasion, the coolant temperature rises gradually and little or no surge develops and valve member 362 is not moved to the closed position and remains in the opened position. Because valve member 362 is not blocking the flow of liquid and vapor through vacuum-relief valve 358, vapor escapes to overflow tank 14. As vapor passes over valve member 362, its temperature rises and snaps to the activated position as shown in FIG. 15 to compress spring 268. According to the preferred embodiment of the present invention, valve member 362 activates at approximately 200–210° F, (just below the boiling point of the coolant), but it is within the scope of the present disclosure for other temperatures to be selected. When valve member 362 is activated, vacuum-relief valve 358 is "sprung" so and valve member 362 is urged to the closed position blocking the flow of fluid through flow passage 167.

During activation, valve member 362 compresses spring 268 so that valve member 362 is pulled to the closed position blocking the flow of additional vapor or liquid through vacuum-relief valve 358. If valve member 362 is not moved to the closed position, vapor and liquid could continue to pass to overflow tank 14 and into the atmosphere. If too much vapor and liquid were permitted to escape in this manner, the radiator and the remainder of the cooling system would develop a coolant deficiency and the cooling capacity of the cooling system would decrease. Such a decrease could allow areas within the cooling system to develop air pockets. The areas normally protected by fluid vacated by the air pockets could suffer catastrophic failure and severely damage the engine. Thus, valve member 362 retards or prevents this catastrophic failure by preventing excess vapor from escaping the cooling system.

Upon the development of abnormally high superatmospheric liquid pressure in the radiator, creating upward liquid pressures on valve member 362 and a peripheral region 175 of seal 152, pressure-relief valve 142 lifts bodily upward, permitting the flow of radiator fluid around seal 152 and out overflow port 196 through tube 178 running to overflow tank 14.

Figure 16:
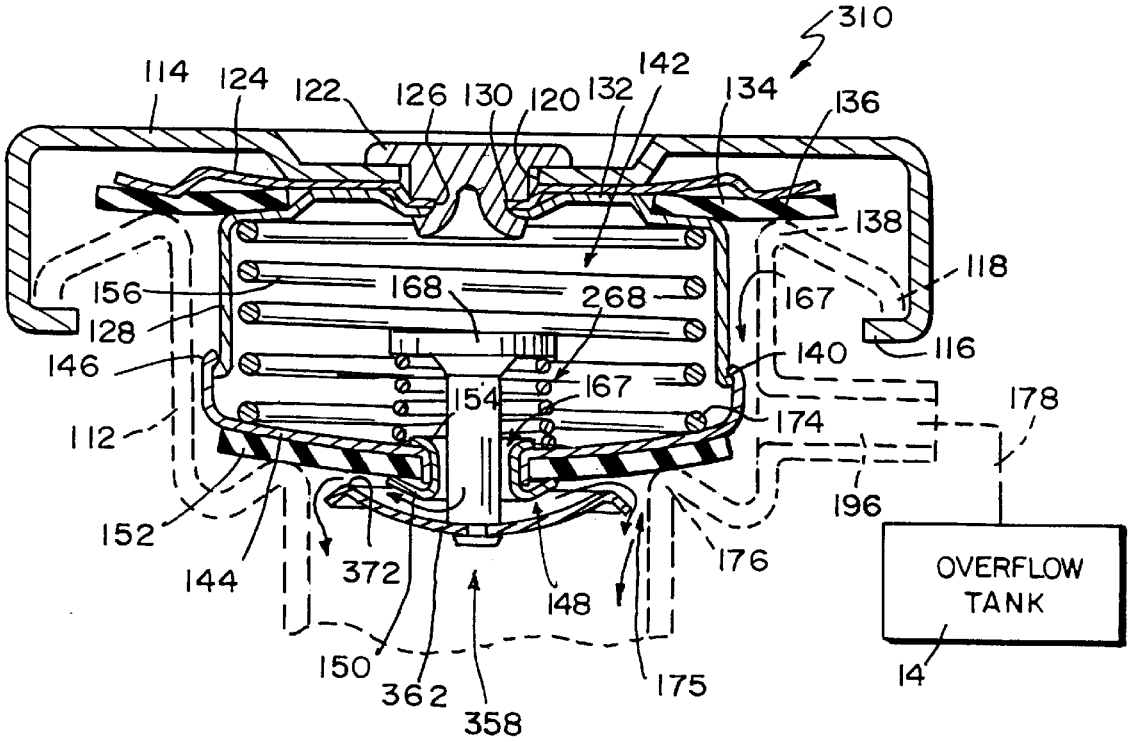
FIG. 16 is a cross-sectional view similar to FIG. 14 showing a vacuum condition existing in the radiator to pull the vacuum-relief valve against the activated temperature-activated valve member and spring so that coolant is drawn from the overflow tank to the radiator through the vacuum-relief valve.

Upon the development of subatmospheric (negative) pressures within the radiator when the engine has cooled, pressure-relief valve 142 reseats on valve seat 176 and valve member 362 moves to the opened position against compressed spring 268, thereby allowing coolant to be siphoned back from the overflow tank to pass through flow passage 167 defined by the clearance region between cylinder 178 and shank 160, and past peripheral region 165 of valve member 362 to return to the radiator fluid reservoir. If the coolant returning from overflow tank 14 is at a temperature below a low predetermined level, valve member 362 remains relaxed and coolant continues to flow from overflow tank 14 to the radiator. If the coolant returning from overflow tank 14 is at a temperature above the predetermined high level, valve member 362 activates, but continues to pull against spring 268 and permit the flow of coolant back to the radiator as shown in FIG. 16. Spring 268 has a predetermined spring constant that permits compression during vacuum conditions to permit activated valve member 362 to be drawn to the opened position against the bias of compressed spring 268 to relieve the vacuum condition.

Thus, according to the present invention, a relief valve is provided that converts between an "unsprung" state and a "sprung" state dependent on a predetermined temperature in or related to the cooling system. A temperature-activated element provides a sensor that detects a condition in the cooling system to provide the conversion between the two states and a biasing actuator operable against a valve member in the sprung state. The relief valve provide a valve member and a spring that permits the valve member to remain open below a predetermined temperature and then biases the valve member to a closed position which may be overcome by the valve at a predetermined pressure. According to alternative embodiments, the relief valve does not include a spring so that the valve member moves between closed and opened positions when the temperature activated element is activated and deactivated.

Although the invention has been disclosed in detail with reference to certain preferred embodiments, variations and modifications exist within the scope and spirit of the invention.

What is claimed is:

1. A cooling system closure comprising a closure apparatus adapted to mount on a cooling system and formed to include a flow passage arranged to receive fluid discharged from the cooling system and a relief valve positioned to move between an opened position permitting fluid to flow through the flow passage and a closed position blocking the flow of fluid through the flow passage, the relief valve including a temperature-activated element moving to a first position when heated to a first predetermined temperature to urge the relief valve to the closed position and a second position when cooled below a second predetermined temperature to permit the relief valve to move to the opened position.

2. The cooling system closure of claim 1, wherein the closure apparatus includes an outer shell and further comprising a pressure-relief valve positioned in the outer shell to move between an opened position permitting fluid to flow from the cooling system and a closed position sealing the cooling system to block the flow of fluid from the cooling system.

3. The cooling system closure of claim 1, wherein the temperature-activated element is positioned between the outer shell and the pressure-relief valve.

4. The cooling system closure of claim 3, wherein the relief valve further includes a valve member positioned to block the flow of fluid through the flow passage upon movement of the relief valve to the closed position and to permit the flow of fluid through the flow passage upon movement of the relief valve to the opened position, the temperature-activated element is made of a spring material to yieldably urge the valve member to block the flow of fluid when the temperature-activated element is in the first position.

5. The cooling system closure of claim 3, wherein the relief valve further includes a spring positioned to yieldably urge the relief valve to the closed position when the temperature-activated element is in the first position.

6. The cooling system closure of claim 5, wherein the relief valve further includes a valve member positioned to block the flow fluid through the flow passage upon movement of the relief valve to the closed position and to permit the flow of fluid through the flow passage upon movement of the relief valve to the opened position and the spring is positioned to yieldably urge the valve member to block the flow of fluid through the flow passage.

7. The cooling system closure of claim 2, wherein the pressure-relief valve is positioned between the outer shell and the temperature-activated element.

8. The cooling system closure of claim 7, wherein the temperature-activated element is positioned to block the flow of fluid through the flow passage upon movement of the relief valve to the closed position and to permit the flow of fluid through the flow passage upon movement of the relief valve to the opened position.

9. The cooling system closure of claim 8, wherein the relief valve further includes a spring positioned to yieldably urge the temperature-activated element to block the flow of fluid through the flow passage.

10. The cooling system closure of claim 1, wherein the relief valve further includes a spring positioned to yieldably urge the relief valve to the closed position when the temperature-activated element is in the first position.

11. The cooling system closure of claim 10, wherein the relief valve further includes a valve member positioned to block the flow of fluid through the flow passage upon movement of the relief valve to the closed position and to permit the flow of fluid through the flow passage upon movement of the relief valve to the opened position and the spring is positioned to yieldably urge the valve member to block the flow of fluid through the flow passage.

12. The cooling system closure of claim 10, wherein the temperature-activated element is positioned to block the flow of fluid through the flow passage upon movement of the relief valve to the closed position and to permit the flow of fluid through the flow passage upon movement of the relief valve to the opened position and the spring is positioned to yieldably urge the temperature-activated element to block the flow of fluid through the flow passage.

13. The cooling system closure of claim 10, wherein the spring has a predetermined spring constant permitting the relief valve to be drawn to the opened position by a negative pressure condition extant in the cooling system while the temperature-activated element is in the first position to permit relief of the negative-pressure condition extant in the cooling system.

14. The cooling system closure of claim 1, wherein the temperature-activated element is positioned to block the flow of fluid through the flow passage upon movement of the relief valve to the closed position and to permit the flow of fluid through the flow passage upon movement of the relief valve to the opened position.

15. The cooling system closure of claim 1, wherein the relief valve further includes a valve member positioned to block the flow of fluid through the flow passage upon movement of the relief valve to the closed position and to permit the flow of fluid through the flow passage upon movement of the relief valve to the opened position and the temperature-activated element is made of a spring material to yieldably urge the valve member to block the flow of fluid when the temperature-activated element is in the first position.

16. The cooling system closure of claim 1, wherein the temperature-activated element is made of a nickel titanium alloy.

17. The cooling system closure of claim 1, wherein the temperature-activated element is made of a first layer of material having a first coefficient of thermal expansion and a second layer of material having a second coefficient of thermal expansion that is greater than the first coefficient of thermal expansion.

18. The cooling system closure of claim 1, wherein the closure apparatus is a radiator cap adapted to be removably mounted on a radiator of a cooling system.

19. A cooling system closure comprising a closure apparatus adapted to close a cooling system and defining a flow passage arranged to communicate fluid discharged from the cooling system and means for controlling the flow of fluid through the flow passage, the controlling means being temperature activated to move from an opened position permitting the flow of fluid through the flow passage when the temperature extant in the cooling system is below a first predetermined temperature level and a closed position blocking the flow of fluid through the flow passage when the temperature extant in the cooling system is above a second predetermined temperature level.

20. The cooling system closure of claim 19, wherein the control means includes a valve member positioned to block the flow of fluid from the flow passage when the control means is in the closed position and to permit the flow of fluid through the flow passage when the control means is in the opened position and a temperature-activated spring that assumes a first shape when at a temperature above the second predetermined level and a second shape when at a temperature below the first predetermined level, the temperature-activated spring being positioned to urge the valve member to block the flow of fluid through the flow passage while in the first shape.

21. The cooling system closure of claim 19, wherein the control means includes a temperature-activated valve member positioned to block the flow of fluid through the flow passage when the temperature in the cooling system is above the second predetermined level and permit the flow of fluid through the flow passage when the temperature in the cooling system is below the first predetermined level.

22. The cooling system closure of claim 19, wherein the control means includes a spring and a temperature-activated element positioned to compress the spring when the temperature extant in the cooling system is above the second predetermined level to urge the control means to the closed position.

23. The cooling system closure of claim 22, wherein the spring has a predetermined spring constant permitting fluid to flow through the flow passage when a negative pressure condition exists in the cooling system and the temperature extant in the cooling system is above the second predetermined level.

24. The cooling system closure of claim 19, wherein the closure apparatus is a radiator cap adapted to be removably mounted on a radiator of a cooling system.

25. A cooling system closure comprising a closure apparatus configured to couple to a cooling system and configured to receive fluid discharged from the cooling system and a relief valve positioned to move between an opened position permitting the flow of fluid through the closure apparatus and a closed position blocking the flow of fluid through the closure apparatus, the relief valve including a temperature-activated element moving between an activated position when the temperature extant in the cooling system is above a first predetermined temperature and a deactivated position when the temperature extant in the cooling system is below a second predetermined temperature, the temperature-activated element being positioned to urge the relief valve to the closed position when in the activated position.

26. A cooling system closure according to claim 25, wherein the relief valve further includes a spring positioned to move between a first position having a first level of stored energy when the temperature activated element is in the deactivated position and a second position having a second level of stored energy when the temperature-activated element is in the activated position that is greater than the first level of stored energy to yieldably urge the relief valve to the closed position.

27. A cooling system closure according to claim 26, wherein the spring is configured to move to a third position having a third level of stored energy when the temperature-activated element is in the activated position and the relief valve is in the closed position and the third level of stored energy is greater than the second level of stored energy.

28. A cooling system closure according to claim 25, wherein the relief valve further includes a valve member positioned to block the flow of fluid through the closure apparatus when the relief valve is in the closed position and to permit fluid to flow through the closure apparatus when the relief valve is in the opened position.

29. A cooling system closure according to claim 25, wherein the temperature-activated element is positioned to block the flow of fluid through the closure apparatus when the relief valve is in the closed position and to permit fluid to flow through the closure apparatus when the relief valve is in the opened position.

30. A cooling system closure according to claim 25, wherein the temperature-activated member is made of a spring material and has a first level of stored energy when in the deactivated position and a second level of stored energy when in the activated position that is greater that the first level of stored energy.

31. A cooling system closure according to claim 30, wherein the temperature-activated member is movable to another position having a third level of stored energy greater than the second level of stored energy when the relief valve is in the opened position and the temperature of the fluid in the cooling system is above the first predetermined temperature.

32. The cooling system closure of claim 25, wherein the closure apparatus is a radiator cap adapted to be removably mounted on a radiator of a cooling system.

33. A cooling system closure comprising a closure apparatus adapted to seal a cooling system and formed to include a flow passage arranged to receive fluid discharged from the cooling system, a valve member positioned to move between an opened position permitting fluid to flow through the flow passage and a closed position blocking the flow of fluid through the flow passage, and a temperature-activated spring moving to an activated position when heated to a first predetermined temperature to urge the valve member to the closed position and a deactivated position when cooled below a second predetermined temperature to permit the valve member to move to the opened position.

34. The cooling system closure of claim 33, wherein the temperature-activated spring has a predetermined spring constant permitting the valve member to be drawn to the first position by negative pressure extant in the cooling system while the temperature-activated spring is in the activated position to permit relief of the negative pressure extant in the cooling system.

35. The cooling system closure of claim 33, wherein the temperature-activated spring is a leaf spring.

36. A cooling system closure comprising a closure apparatus adapted to seal a cooling system and formed to include a flow passage arranged to receive fluid discharged from the cooling system, a valve member positioned to move between an opened position permitting fluid to flow through the flow passage and a closed position blocking the flow of fluid through the flow passage, a spring, and a temperature-activated element moving to an activated position when heated to a first predetermined temperature to compress the spring and urge the valve member to the closed position and a deactivated position when cooled below a second predetermined position to decompress the spring and move the valve member to the opened position.

37. The cooling system closure of claim 36, wherein the temperature-activated element is disk-shaped.

38. The cooling system closure of claim 36, wherein the temperature-activated element is positioned adjacent the spring.

39. The cooling system closure of claim 36, wherein the spring has a predetermined spring constant permitting the valve member to be drawn to the first position by negative pressure extant in the cooling system while the temperature-activated element is in the activated position to permit relief of the negative pressure extant in the cooling system.

40. A cooling system closure comprising a closure apparatus adapted to seal a cooling system and formed to include a flow passage arranged to receive fluid discharged from the cooling system and a temperature-activated valve member positioned to move between an opened position permitting fluid to flow through the flow passage and a closed position blocking the flow of fluid through the flow passage, the temperature-activated valve member moving to the closed position when heated to a first predetermined temperature and the opened position when cooled below a second predetermined temperature.

41. The cooling system closure of claim 40, further comprising a spring positioned to urge the temperature-activated valve member to the closed position when the temperature-activated valve member is heated above the first predetermined temperature.

42. The cooling system closure of claim 40, wherein the temperature-activated valve member is disk-shaped.

43. The cooling system closure of claim 40, further comprising a pressure-relief valve, wherein the closure apparatus includes an outer shell and the pressure-relief valve is positioned between the temperature-activated valve member and the outer shell.

44. The cooling system closure of claim 1, further comprising a pressure-relief valve engaging the closure apparatus and positioned to open a second flow passage through which fluid from the cooling system flows and to close the second flow passage to block the flow of fluid from the cooling system through the second flow passage.

45. The cooling system closure of claim 1, further comprising a valve seat, and wherein the relief valve engages the valve seat in response to the temperature-activated element being heated to the first predetermined temperature and the relief valve disengages the valve seat in response to a first pressure level in the flow passage that is higher than a second pressure level in the cooling system.

46. The cooling system closure of claim 21, further comprising a pressure-relief valve engaging the closure apparatus and positioned to open a second flow passage through which fluid from the cooling system flows and to close the second flow passage to block the flow of fluid from the cooling system through the second flow passage.

47. The cooling system closure of claim 21, further comprising a valve seat, and wherein the temperature-activated valve member engages the valve seat to block the flow of fluid through the flow passage and the temperature-activated valve member disengages the valve seat in response to a first pressure level in the flow passage that is higher than a second pressure level in the cooling system.

48. The cooling system closure of claim 25, further comprising a valve seat, and wherein the relief valve engages the valve seat in response to the temperature-activated element moving to the activated position and the relief valve disengages the valve seat in response to a first pressure level in the closure apparatus that is higher than a second pressure level in the cooling system.

49. The cooling system closure of claim 36, further comprising a pressure-relief valve engaging the closure apparatus and positioned to open a second flow passage through which fluid from the cooling system flows and to close the second flow passage to block the flow of fluid from the cooling system through the second flow passage.

50. The cooling system closure of claim 36, further comprising a valve seat, and wherein the valve member engages the valve seat in response to the temperature-activated element moving to the activated position and the valve member disengages the valve seat in response to a first pressure level in the flow passage that is higher than a second pressure level in the cooling system.

51. The cooling system closure of claim 40, further comprising a pressure-relief valve engaging the closure apparatus and positioned to open a second flow passage through which fluid from the cooling system flows and to close the second flow passage to block the flow of fluid from the cooling system through the second flow passage.

52. The cooling system closure of claim 40, further comprising a valve seat, and wherein the temperature-activated valve member engages the valve seat in response to the temperature-activated valve member being heated to the first predetermined temperature and the temperature-activated valve member disengages the valve seat in response to a first pressure level in the flow passage that is higher than a second pressure level in the cooling system.

* * * * *